US009725965B2

(12) United States Patent
Wiercigroch

(10) Patent No.: US 9,725,965 B2
(45) Date of Patent: Aug. 8, 2017

(54) VIBRATION TRANSMISSION AND ISOLATION

(75) Inventor: Marian Wiercigroch, Aberdeen (GB)

(73) Assignee: ITI SCOTLAND LIMITED, Glasgow (GB)

( * ) Notice: Subject to any disclaimer, the term of this patent is extended or adjusted under 35 U.S.C. 154(b) by 958 days.

(21) Appl. No.: 13/992,227

(22) PCT Filed: Dec. 7, 2011

(86) PCT No.: PCT/EP2011/072121
§ 371 (c)(1),
(2), (4) Date: Dec. 6, 2013

(87) PCT Pub. No.: WO2012/076617
PCT Pub. Date: Jun. 14, 2012

(65) Prior Publication Data

US 2014/0083772 A1 Mar. 27, 2014

(30) Foreign Application Priority Data

| | | |
|---|---|---|
| Dec. 7, 2010 | (GB) | 1020660.5 |
| Feb. 14, 2011 | (GB) | 1102558.2 |
| Mar. 23, 2011 | (GB) | 1104874.1 |

(51) Int. Cl.

| | |
|---|---|
| ***E21B 3/04*** | (2006.01) |
| ***E21B 17/07*** | (2006.01) |
| ***E21B 7/24*** | (2006.01) |
| ***E21B 44/00*** | (2006.01) |

(52) U.S. Cl.
CPC ..... *E21B 17/07* (2013.01); *E21B 3/04* (2013.01); *E21B 7/24* (2013.01); *E21B 44/00* (2013.01)

(58) Field of Classification Search
USPC ..... 175/57, 40
See application file for complete search history.

(56) References Cited

U.S. PATENT DOCUMENTS

| | | | |
|---|---|---|---|
| 3,768,576 | A | 10/1973 | Martini |
| 4,023,628 | A | 5/1977 | Bodine |
| 4,276,947 | A | 7/1981 | Hebel |
| 4,502,552 | A | 3/1985 | Martini |

(Continued)

FOREIGN PATENT DOCUMENTS

| | | | |
|---|---|---|---|
| GB | 2328342 | A | 2/1999 |
| GB | 2473619 | A | 3/2011 |

(Continued)

OTHER PUBLICATIONS

Dantinne, Patrick; International Search Report; Date of Mailing of Report: Sep. 24, 2012; International Application No. PCT/EP2011/072121; 4 pages.

(Continued)

*Primary Examiner* — Taras P Bemko
(74) *Attorney, Agent, or Firm* — Gavrilovich, Dodd & Lindsey LLP

(57) ABSTRACT

An apparatus for use in resonance enhanced rotary drilling. The apparatus comprising one or both of: (a) a vibration isolation unit; and (b) a vibration transmission unit. The vibration isolation unit and/or the vibration transmission unit typically comprising a spring system comprising two or more frusto-conical springs arranged in series.

28 Claims, 12 Drawing Sheets

(56) References Cited

U.S. PATENT DOCUMENTS

| | | | | |
|---|---|---|---|---|
| 2006/0157280 | A1* | 7/2006 | Fincher | E21B 7/24 175/57 |
| 2007/0221408 | A1 | 9/2007 | Hall et al. | |

FOREIGN PATENT DOCUMENTS

| | | | |
|---|---|---|---|
| GB | 2489227 | A | 9/2012 |
| WO | 2007/141550 | A1 | 12/2007 |

OTHER PUBLICATIONS

"Disc spring load and stress calculations," Jul. 18, 2006; Retrieved from Internet: URL:http://www.spaenaur.com/pdf/sectionD/D44.pdf.

Ellis, Lyndon, Search Report, European Patent Office, GB1121013.5, Mar. 2, 2012.

Sarah Tatum, Office Action, Application No. GB1121013.5, The United Kingdom Intellectual Property Office, Aug. 1, 2016.

* cited by examiner

VIBRATION TRANSMISSION AND ISOLATION

CROSS REFERENCE TO RELATED APPLICATIONS

This application is a National Stage Application filed under 35 U.S.C. §371 and claims priority to International Application Serial No. PCT/EP2011/072121, filed Dec. 7, 2011, which application claims priority to Great Britain Application Nos. 1020660.5, filed Dec. 7, 2010, 1102558.2, filed Feb. 14, 2011, and 1104874.1, filed Mar. 23, 2011, the disclosures of which are incorporated herein by reference.

The present invention relates to percussion enhanced rotary drilling, and in particular to resonance enhanced drilling. Embodiments of the invention are directed to apparatus and methods for resonance enhanced rotary drilling, and in particular to vibration transmission and isolation units used to improve performance in the apparatus and methods. Further embodiments of this invention are directed to resonance enhanced drilling equipment which may be controllable according to these methods and apparatus. Certain embodiments of the invention are applicable to any size of drill or material to be drilled. Certain more specific embodiments are directed at drilling through rock formations, particularly those of variable composition, which may be encountered in deep-hole drilling applications in the oil, gas and mining industries.

Percussion enhanced rotary drilling is known per se. A percussion enhanced rotary drill comprises a rotary drill bit and an oscillator for applying oscillatory loading to the rotary drill bit. The oscillator provides impact forces on the material being drilled so as to break up the material which aids the rotary drill bit in cutting though the material.

Resonance enhanced rotary drilling is a special type of percussion enhanced rotary drilling in which the oscillator is vibrated at high frequency so as to achieve resonance with the material being drilled. This results in an amplification of the pressure exerted at the rotary drill bit thus increasing drilling efficiency when compared to standard percussion enhanced rotary drilling.

U.S. Pat. No. 3,990,522 discloses a percussion enhanced rotary drill which uses a hydraulic hammer mounted in a rotary drill for drilling bolt holes. It is disclosed that an impacting cycle of variable stroke and frequency can be applied and adjusted to the natural frequency of the material being drilled to produce an amplification of the pressure exerted at the tip of the drill bit. A servovalve maintains percussion control, and in turn, is controlled by an operator through an electronic control module connected to the servovalve by an electric conductor. The operator can selectively vary the percussion frequency from 0 to 2500 cycles per minute (i.e. 0 to 42 Hz) and selectively vary the stroke of the drill bit from 0 to ⅛ inch (i.e. 0 to 3.175 mm) by controlling the flow of pressurized fluid to and from an actuator. It is described that by selecting a percussion stroke having a frequency that is equal to the natural or resonant frequency of the rock strata being drilled, the energy stored in the rock strata by the percussion forces will result in amplification of the pressure exerted at the tip of the drill bit such that the solid material will collapse and dislodge and permit drill rates in the range 3 to 4 feet per minute.

There are several problems which have been identified with the aforementioned arrangement and which are discussed below.

High frequencies are not attainable using the apparatus of U.S. Pat. No. 3,990,522 which uses a relatively low frequency hydraulic oscillator. Accordingly, although U.S. Pat. No. 3,990,522 discusses the possibility of resonance, it would appear that the low frequencies attainable by its oscillator are insufficient to achieve resonance enhanced drilling through many hard materials.

Regardless of the frequency issue discussed above, resonance cannot easily be achieved and maintained in any case using the arrangement of U.S. Pat. No. 3,990,522, particularly if the drill passes through different materials having different resonance characteristics. This is because control of the percussive frequency and stroke in the arrangement of U.S. Pat. No. 3,990,522 is achieved manually by an operator. As such, it is difficult to control the apparatus to continuously adjust the frequency and stroke of percussion forces to maintain resonance as the drill passes through materials of differing type. This may not be such a major problem for drilling shallow bolt holes as described in U.S. Pat. No. 3,990,522. An operator can merely select a suitable frequency and stroke for the material in which a bolt hole is to be drilled and then operate the drill. However, the problem is exacerbated for deep-drilling through many different layers of rock. An operator located above a deep-drilled hole cannot see what type of rock is being drilled through and cannot readily achieve and maintain resonance as the drill passes from one rock type to another, particularly in regions where the rock type changes frequently.

Some of the aforementioned problems have been solved by the present inventor as described in WO 2007/141550. WO 2007/141550 describes a resonance enhanced rotary drill comprising an automated feedback and control mechanism which can continuously adjust the frequency and stroke of percussion forces to maintain resonance as a drill passes through rocks of differing type. The drill is provided with an adjustment means which is responsive to conditions of the material through which the drill is passing and a control means in a downhole location which includes sensors for taking downhole measurements of material characteristics whereby the apparatus is operable downhole under closed loop real-time control.

US2006/0157280 suggests down-hole closed loop real-time control of an oscillator. It is described that sensors and a control unit can initially sweep a range of frequencies while monitoring a key drilling efficiency parameter such as rate of progression (ROP). An oscillation device can then be controlled to provide oscillations at an optimum frequency until the next frequency sweep is conducted. Periodicity of the frequency sweep can be based on a one or more elements of the drilling operation such as a change in formation, a change in measured ROP, a predetermined time period or instruction from the surface. The detailed embodiment utilises an oscillation device which applies torsional oscillation to the rotary drill bit and torsional resonance is referred to. However, it is further described that exemplary directions of oscillation applied to the drill bit include oscillations across all degrees of freedom and are not utilised in order to initiate cracks in the material to be drilled. Rather, it is described that rotation of the drill bit causes initial fractioning of the material to be drilled and then a momentary oscillation is applied in order to ensure that the rotary drill bit remains in contact with the fracturing material. There does not appear to be any disclosure or suggestion of providing an oscillator which can import sufficiently high axial oscillatory loading to the drill bit in order to initiate cracks in the material through which the rotary drill bit is passing as is required in accordance with resonance enhanced drilling as described in WO 2007/141550.

Despite the solutions described in the prior art, there are still problems associated with known methods and apparatus for resonance enhanced drilling. In particular, due to the resonance which is generated by the high oscillatory loading in the system, a large and/or rapid degree of axial movement occurs. However, not all components used in the apparatus are easily able to withstand large dynamic axial movement, particularly over an extended period of time. Accordingly, it is desirable to improve upon known rotary drilling techniques and apparatus by employing improved vibration isolation in order to protect vulnerable components of the apparatus, and/or by employing improved vibration transmission in order to ensure that the required dynamic axial load is transferred to the drill bit. It is a particular challenge to solve both of these problems simultaneously, since the vibration isolation unit should not interfere with the required vibration transmission, whilst the vibration transmission unit should not interfere with the required vibration isolation.

In conventional drilling apparatus, some attempts have been made to improve vibration isolation and transmission. U.S. Pat. No. 4,067,596 discloses drilling apparatus in which axial loads are borne by elastomer rings. These structures have a 'damping' effect, and thus may act as vibrational isolating units. U.S. Pat. No. 3,768,576 discloses energy transfer 'thrust rings' in a drilling apparatus. These rings may be frusto-conical in shape or may be coil springs. EP 0,026,100 discloses a shock absorber for drilling apparatus. It is described as being capable of transmitting axial load. Typically it is formed from a resilient deformable substance, such as a rubber, but may also take the form of a helical spring with a screw thread form. GB 2,332,690 concerns a drilling apparatus that is provided with axial dynamic load using a mechanical oscillator. Helical springs and/or hydraulic dampers are employed to control dynamic axial loading. Finally, U.S. Pat. No. 4,139,994 concerns a drilling apparatus with a damping means to control axial movement. The means is constituted by a urethane annulus, which is tapered at each end such that the stiffness of the annulus varies with displacement.

However, none of the known art teaches the use of a vibration isolation or transmission unit in resonance enhanced drilling apparatus, in which the axial oscillatory load is significantly different to conventional drilling techniques.

It is an aim of embodiments of the present invention to make improvements to the known art in order to increase the operational reliability and lifetime of drilling apparatus, increase drilling efficiency, increase drilling speed and borehole stability and quality, while limiting wear and tear on the apparatus. It is a further aim to more precisely control resonance enhanced drilling, particularly when drilling through rapidly changing rock types.

Accordingly, the present invention provides an apparatus for use in resonance enhanced rotary drilling, which apparatus comprises one or both of:

(a) a vibration isolation unit; and (b) a vibration transmission unit.

The vibration isolation unit is not especially limited, provided that it is capable of protecting sensitive parts of the apparatus from vibration, without unduly impeding the operation of the apparatus. Similarly, the vibration transmission unit is not especially limited, provided that it is capable of transmitting vibrations to the drill bit to facilitate resonance enhanced drilling operations.

In the present context, isolation means any reduction of vibration sufficient to improve the lifespan of sensitive components. As such, complete isolation of these components from vibration is not necessary, but rather a reduction is required as compared with vibration in the absence of a vibrational isolation unit. Typically, but not exclusively, the vibration isolation unit is operated such that less than 25% of the vibrational energy is transmitted beyond the unit. This may be achieved by operating the oscillator of the resonance enhanced drilling module at frequencies that differ from the natural frequency (resonant frequency) of the vibration isolation unit, and will be explained in more detail later.

In the present context, transmission means transmission of vibration to the drill bit such that there is an increase in vibration as compared with the vibration in the absence of the vibration transmission unit. Typically, this may involve an amplification of vibration by operating the oscillator at frequencies close to the natural frequency (resonant frequency) of the vibration transmission unit, and will be explained in more detail later.

The vibration isolation unit may employed with any type of oscillator used to generate axial dynamic load in the apparatus. The vibration transmission unit may also be employed with any type of oscillator. However, in the case of vibration transmission, such a unit is not always required unless amplification of dynamic axial load is desirable. Thus, a vibration transmission unit is not necessarily required when a mechanical oscillator is employed. However, a vibration transmission unit is desirable when a magnetostrictive oscillator is used.

In the present apparatus, the structure of the vibration isolation unit and/or the vibration transmission unit are not especially limited, provided that in operation they perform the functions described above. However, typically the vibration isolation unit and/or the vibration transmission unit comprise a spring system comprising two or more frusto-conical springs arranged in series. Such frusto-conical springs are particularly suitable, since they have parameters which are readily tuneable to adapt them to the particular drill system being employed.

In typical embodiments, the spring system is one such that the force, P, applied to the spring system can be determined according to the following equation:

$$P = \frac{1.1E\delta C}{R^2}\left[(h-\delta)\left(h-\frac{\delta}{2}\right)t + t^2\right]$$

wherein t is the thickness of the frusto-conical springs, h is the height of the spring system, R is the radius of the spring system, δ is the displacement on the spring system caused by the force P, E is the Young modulus of the spring system, and C is the constant of the spring system. These parameters can be seen in the schematic spring system shown in conjunction with the graph of FIG. 2.

In more typical embodiments, the spring system comprises one or more Belleville springs. Exemplary Belleville springs are depicted in FIGS. 1*a* and 1*b* The spring system may be formed from any material, depending upon the nature of the drilling apparatus used. However, typically the spring system is formed from a metal, such as steel.

The location of the vibration isolation unit within the resonance enhanced rotary drilling apparatus is not especially limited, provided that it performs the functions described above. However, in typical embodiments the vibration isolation unit is situated above the oscillator in the apparatus. Similarly, the location of the vibration transmission unit within the drilling apparatus is not especially limited, provided that it performs the functions described above. However, in typical embodiments the vibration transmission unit is situated below the oscillator.

As has been mentioned above, typically, but not exclusively, the vibration isolation unit is operated such that less than 25% of the vibrational energy is transmitted beyond the unit. This may be achieved by operating the oscillator of the resonance enhanced drilling module at frequencies that differ from the natural frequency (resonant frequency) of the vibration isolation unit. In the case where 25% of the vibrational energy is transmitted beyond the unit, the spring system of the vibration isolation unit obeys the following equation:

$$\omega/\omega_n \geq 2.3$$

wherein $\omega$ is an operational frequency of axial vibration of the resonance enhanced rotary drilling apparatus, and $\omega_n$ is the natural frequency of the spring system. However, in some embodiments less than 90%, 80%, 70%, 60%, 50%, 40%, 30%, 20%, 15%, 10%, 5% and intermediate values of these are also envisaged. The $\omega/\omega_n$ value in such cases may vary from 1.5-10.

As has been mentioned above, typically the vibration transmission unit is operated such that there is an increase in vibration as compared with the vibration in the absence of the vibration transmission unit. Typically, this may involve an amplification of vibration by operating the oscillator of the resonance enhanced drilling module at frequencies close to the natural frequency (resonant frequency) of the vibration transmission unit. Typically, the spring system of the vibration transmission unit obeys the following equation:

$$0.6 \leq \omega/\omega_n \leq 1.2$$

wherein $\omega$ is an operational frequency of axial vibration of the resonance enhanced rotary drilling apparatus, and $\omega_n$ is the natural frequency of the spring system.

The invention further provides a method of drilling comprising operating an apparatus as defined above. Typically the method of drilling comprises controlling an operational frequency of axial vibration of the resonance enhanced rotary drilling apparatus such that the spring system of the vibration isolation unit satisfies the following equation:

$$\omega/\omega_n \geq 2.3$$

wherein $\omega$ represents an operational frequency of axial vibration of the resonance enhanced rotary drilling apparatus, and $\omega_n$ represents the natural frequency of the spring system of the vibration isolation unit. The method of drilling may additionally, or alternatively, comprise controlling an operational frequency of axial vibration of the resonance enhanced rotary drilling apparatus such that the spring system of the vibration transmission unit satisfies the following equation:

$$0.6 \leq \omega/\omega_n \leq 1.2$$

wherein $\omega$ represents an operational frequency of axial vibration of the resonance enhanced rotary drilling apparatus, and $\omega_n$ represents the natural frequency of the spring system of the vibration transmission unit.

The invention will now be described in more detail by way of example only, with reference to the following drawings in which:

FIGS. 1*a* and 1*b* show typical Belleville spring arrangements: (a) a single spring with load, (b) four springs in series.

Figure 8A:
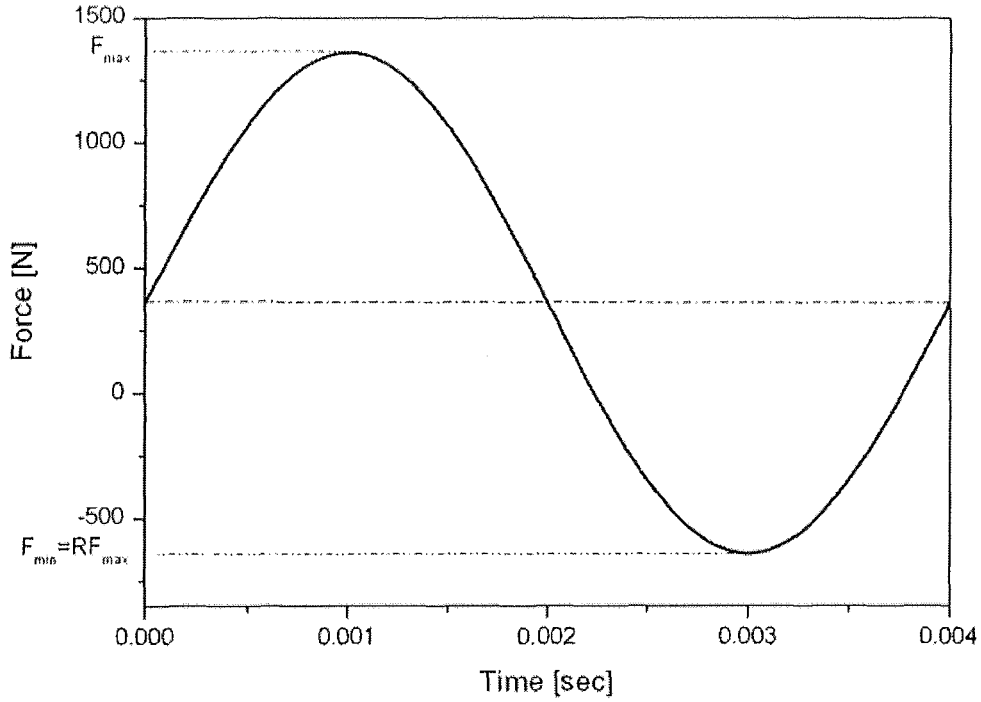
Figure 8B:
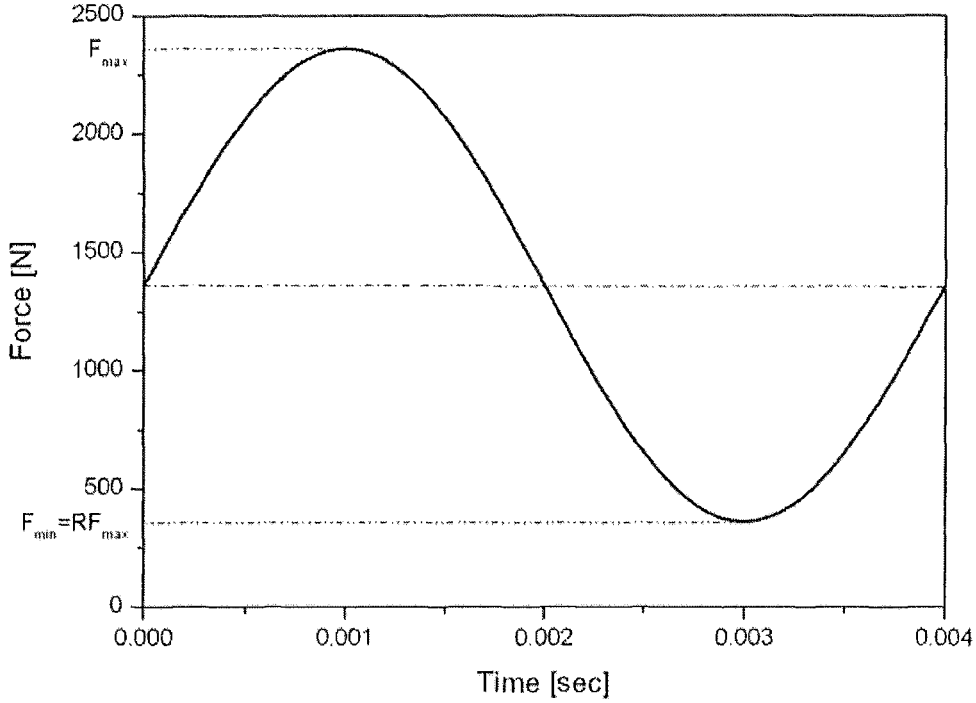

FIGS. 8*a* and 8*b* show graphical approximations of loading condition during the RED drilling process for (a) an exemplary vibration isolation unit and (b) an exemplary vibration transmission unit at a frequency of 250 Hz.

Figure 9A:
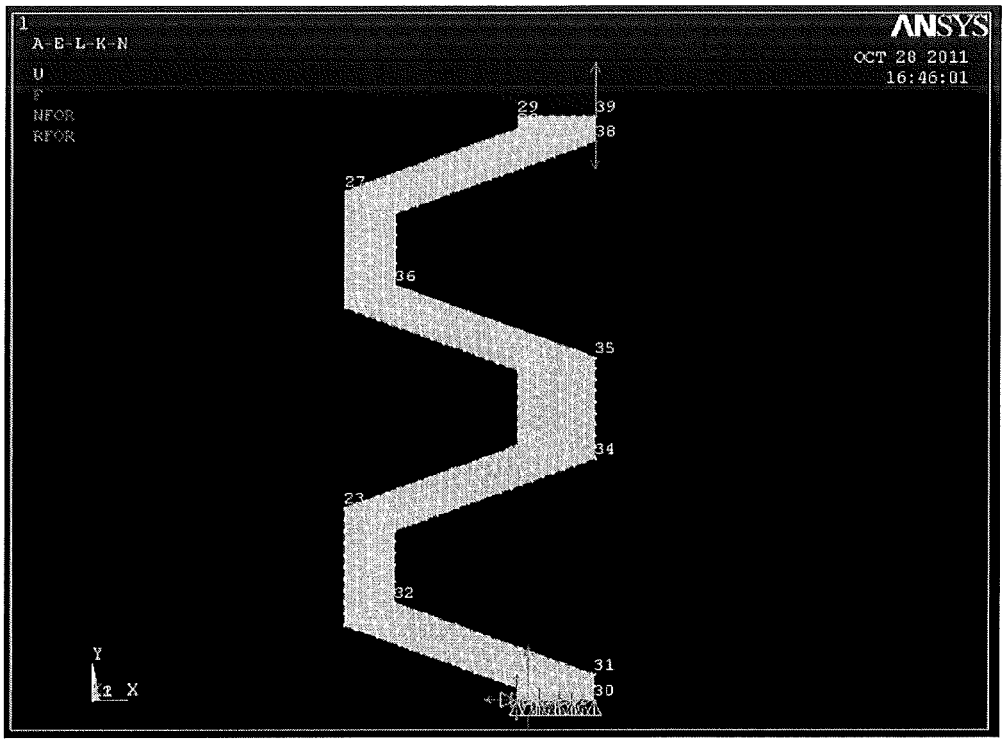
Figure 9B:
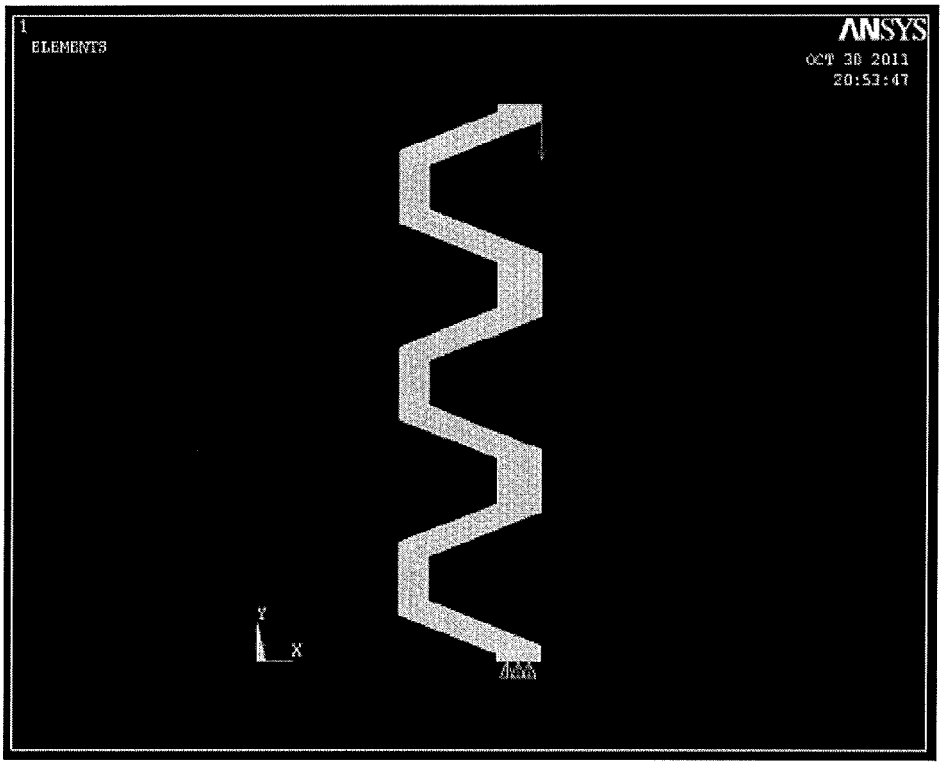
Figure 9C:
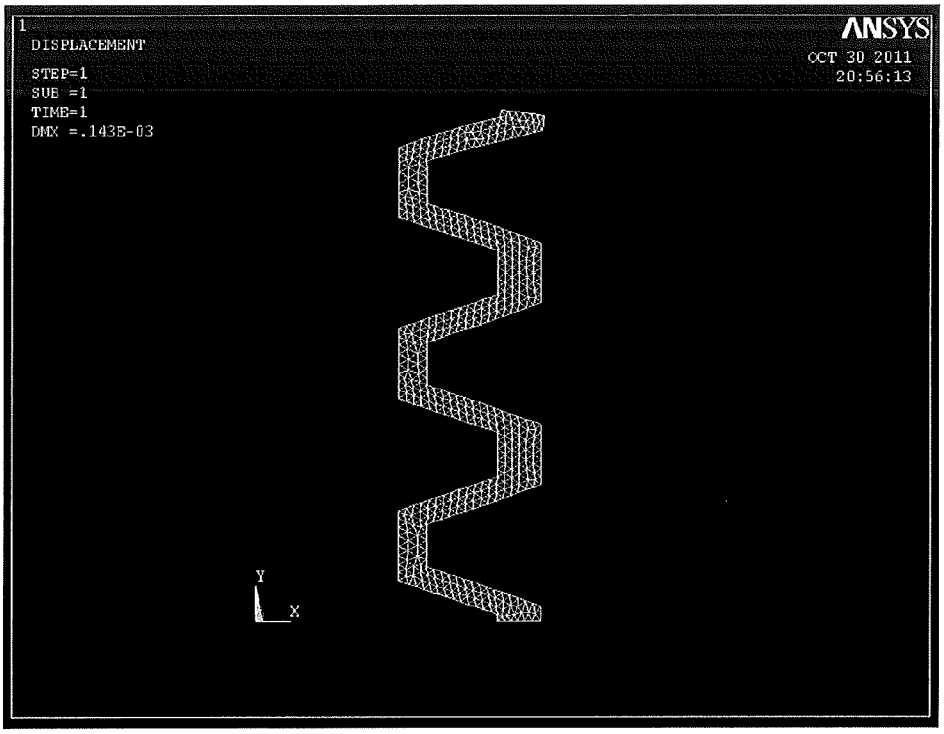
Figure 9D:
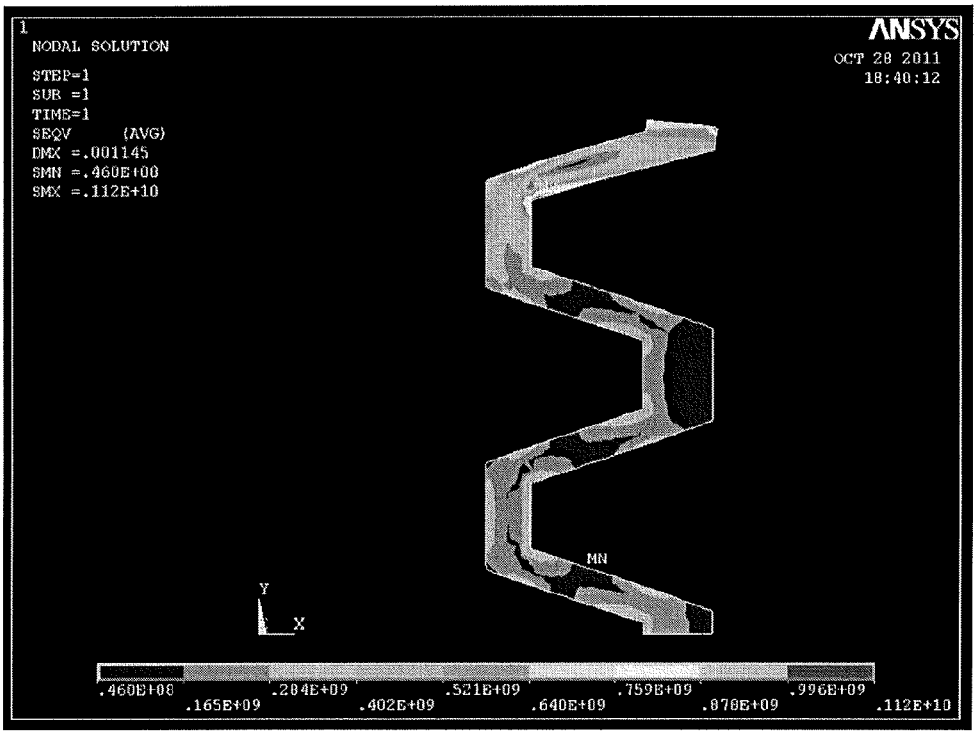
Figure 9E:
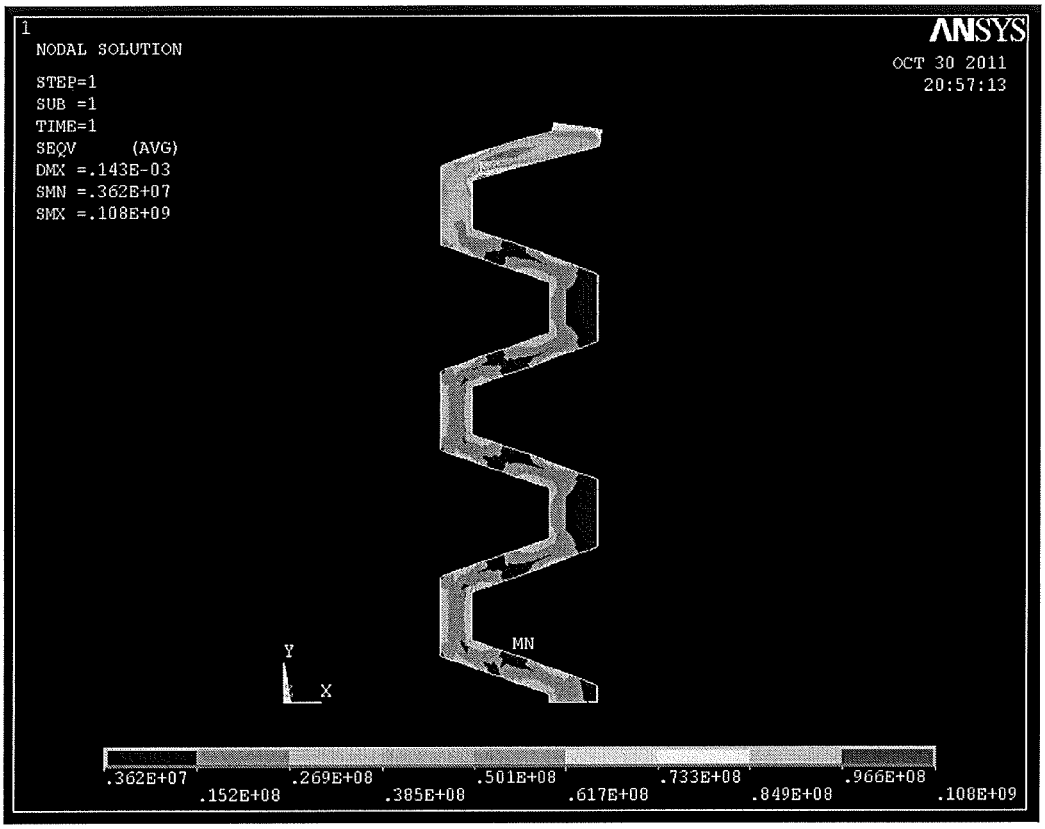

FIGS. 9*a* to 9*e* show a finite element analysis of the RED spring, with approximation of the stress field with linear elements (PLANE 183—quad. Configuration, free mesh) with a compressive force applied at the top of the spring (F=101(N) and a vertical constraint at the bottom (Uy=0). FIG. 9*a* shows loads and constraints on the section of the spring—single bevel. FIG. 9*b* shows loads and constrains on the section of the spring—whole RED spring (two bevels). FIG. 9*c* shows the deformed shape of the spring under prescribed loads. FIG. 9*d* shows the stress field under prescribed loads—single bevel. FIG. 9*e* shows the stress field under prescribed loads—whole RED spring (two bevels).

Figure 10A:
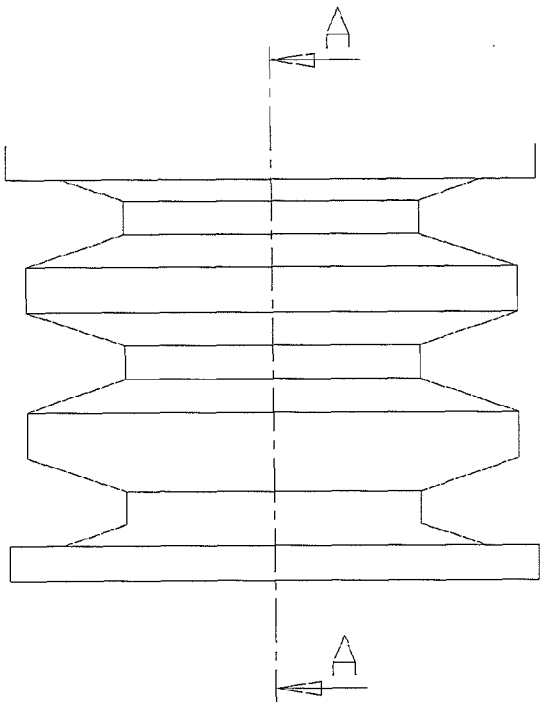
Figure 10B:
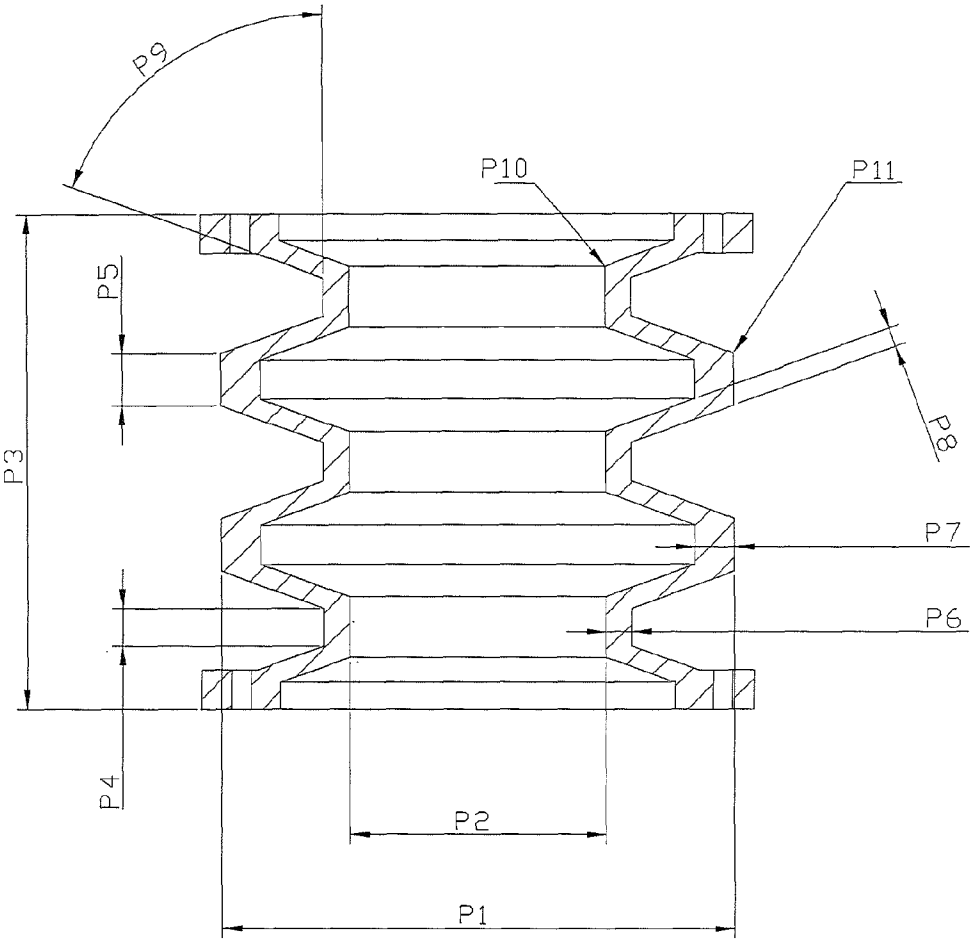

FIGS. 10*a* and 10*b* show a schematic of a structural spring in a parametric form for which the computations in FIGS. 9*a* to 9*e* have been undertaken. Parameters P10 and P11 are radii. P12 is the number of bevels.

Investigations conducted show that the Resonance Enhanced Drilling (RED) technology has an important advantage over standard methods in that it can lead to significantly increased rates of penetration. Two structural parts that play vital roles in the operation of the RED module are the vibration isolation unit, and the vibration transmission unit described above. The vibration transmission unit (which may also be termed the "spring", in the present context) may be positioned below the oscillator (which may also be termed the actuator) and typically functions as a mechanical amplifier of high frequency oscillations that are transmitted to the drill-bit. On the other hand the vibration isolation unit (which may also be termed the vibro-isolator) acts to reduce the vibrations transferred to the rest of the drill-string. In this way, oscillatory behaviour is confined only to the bottom part of the drilling equipment and sensitive equipment can be protected from damage.

Figure 1A:
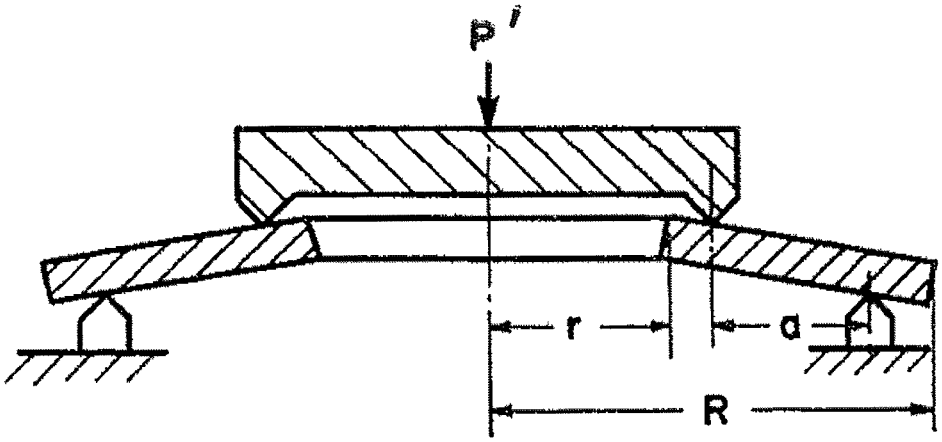
Figure 1B:
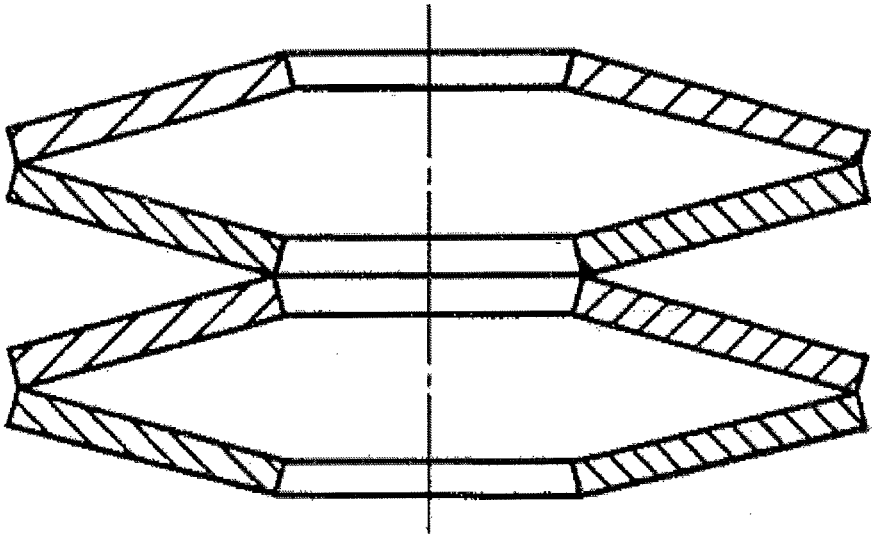

The current design of both the spring and the vibro-isolator is typically, but not exclusively, based on a working principle similar to that used for Belleville-type springs. Cross-sections of a preferred vibro-isolator and a preferred spring are shown respectively in FIGS. 3 and 4. These Figures show that the typical designs resemble a stack of Belleville springs arranged in series (see FIG. 1*b*), which for a given load permits an increased deflection in proportion to the number of disks.

Figure 2:
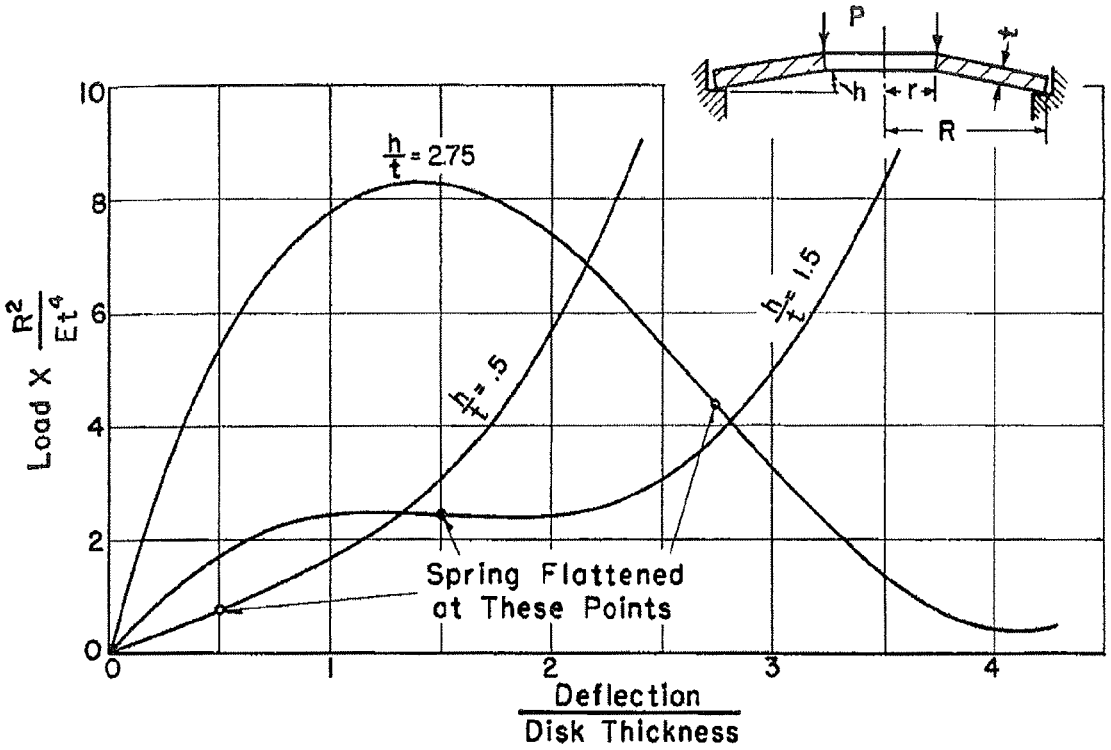
FIG. 2 shows some different characteristics of a single Belleville spring depending on the ratio of cone height h to wall thickness t.

Belleville springs are especially useful for the application in the RED module because of their properties, such as high capacity for a relatively small space requirement, specifically in the direction of load action. Furthermore, their load-deflection characteristics (see FIG. 2) can be easily modified by varying the ratio of cone height to thickness. The small thickness of the conically shaped disks causes significant bending to take place when in compression, which results in an overall reduction in height of the spring and conversely an increase in the height occurs when subjected to tensile load.

Figure 3:
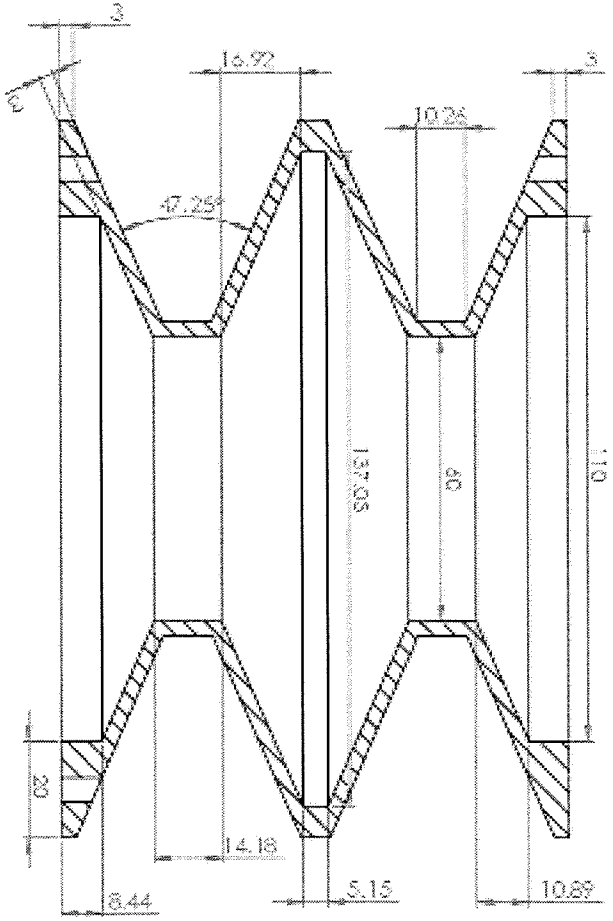
FIG. 3 shows a section view of an exemplary vibration isolation unit of the invention.
Figure 4:
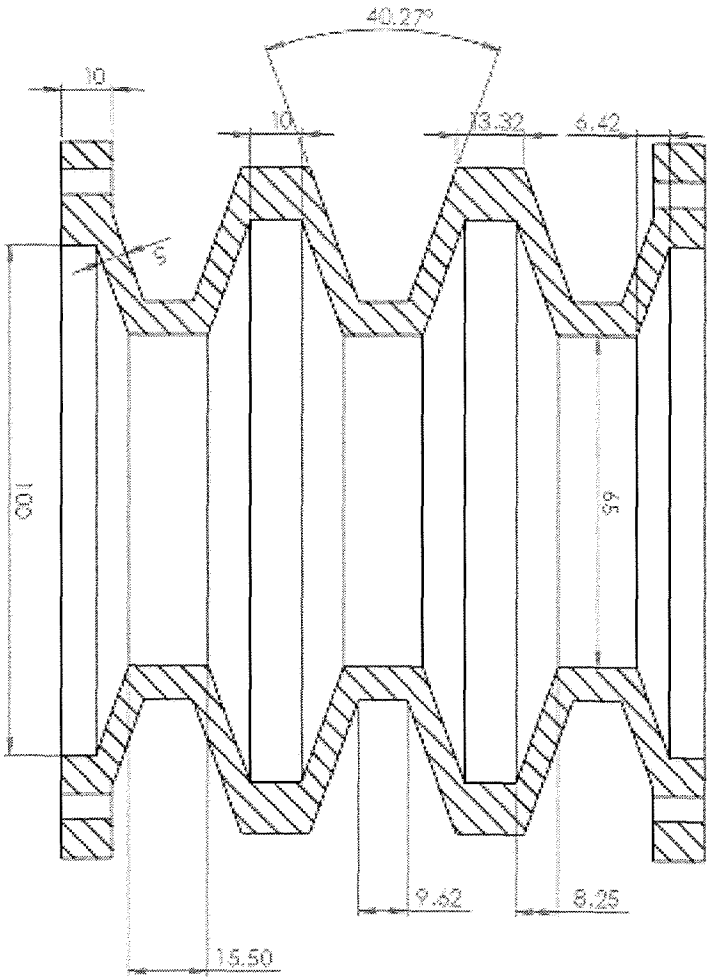
FIG. 4 shows a section view of an exemplary vibration transmission unit of the invention.

On the other hand, relatively large energy storage capacity enables the use of the same principle for vibration damping. Stiffnesses of the vibro-isolator and the spring element will differ as a consequence of difference in shape, size, and in particular the thickness of the material, as shown in FIGS. 3 and 4.

The properties of both parts are intrinsically nonlinear (see for example the graphs in FIG. 2), especially when large deflections occur. As an example, for a single Belleville spring (such as that in FIG. 1*a*) the nonlinear relationship between force P applied at the top of the conical structure and the geometry defined by thickness t and the spring's height h is:

$$P = \frac{1.1E\delta C}{R^2}\left[(h-\delta)\left(h-\frac{\delta}{2}\right)t + t^2\right]$$

In the case of RED, non-linearities are usefully employed, since they enable large deflection to occur at a constant force. However, in order to better perform all desired functions on the RED module, it is desirable that both the spring and the vibro-isolator have appropriate stiffness values. In addition, they should be able to survive the cyclic (fatigue) loads they are subjected to during the course of the drilling operation. The design of the parts is therefore optimised for best dimensions, material selection, and manufacturing. Further details on the finite element analysis that can be used in the design of the RED spring are provided in FIGS. 9 and 10.

As noted earlier, the dimensions of the conically shaped disks that make up the springs influence the stiffness characteristics of the springs and as a result the range of possible forcing frequencies of the resonator. The main operational constraint on the geometry is the outer diameter of the RED drilling module. Since all parts of the module are enclosed in a protective cylindrical structure, this means that diameters of internal parts are defined by the internal diameter of the casing. This leaves the thickness and height of the conically shaped disk as the two dimensions that can be most easily controlled to achieve the desired stiffness properties for the spring and vibro-isolator. Optimisation of the designs therefore typically consists of optimising these two parameters.

In typical embodiments of the invention, the rotary drilling module comprises:

(i) an upper load-cell for measuring static and dynamic axial loading;
(ii) a vibration isolation unit;
(iii) optionally an oscillator back mass;
(iv) an oscillator comprising a dynamic exciter for applying axial oscillatory loading to the rotary drill-bit;
(v) a vibration transmission unit;
(vi) a lower load-cell for measuring static and dynamic axial loading;
(vii) a drill-bit connector; and
(viii) a drill-bit, wherein the upper load-cell is positioned above the vibration isolation unit and the lower load-cell is positioned between the vibration transmission unit and the drill-bit, and wherein the upper and lower load-cells are connected to a controller in order to provide down-hole closed loop real time control of the oscillator.

It is envisaged that this drilling module will be employed as a resonance enhanced drilling module in a drill-string. The drill-string configuration is not especially limited, and any configuration may be envisaged, including known configurations. The module may be turned on or off as and when resonance enhancement is required.

In this apparatus arrangement, the dynamic exciter typically comprises a magnetostrictive exciter. The magnetostrictive exciter is not especially limited, and in particular there is no design restriction on the transducer or method of generating axial excitation. Preferably the exciter comprises a PEX-30 oscillator from Magnetic Components AB.

The dynamic exciter employed in the present arrangement is a magnetostrictive actuator working on the principle that magnetostrictive materials, when magnetised by an external magnetic field, change their inter-atomic separation to minimise total magneto-elastic energy. This results in a relatively large strain. Hence, applying an oscillating magnetic field provides in an oscillatory motion of the magnetostrictive material.

Magnetostrictive materials may be pre-stressed uniaxially so that the atomic moments are pre-aligned perpendicular to the axis. A subsequently applied strong magnetic field parallel to the axis realigns the moments parallel to the field, and this coherent rotation of the magnetic moments leads to strain and elongation of the material parallel to the field. Such magnetostrictive actuators can be obtained from MagComp and Magnetic Components AB. As mentioned above, one particularly preferred actuator is the PEX-30 by Magnetic Components AB.

It is also envisaged that magnetic shape memory materials such as shape memory alloys may be utilized as they can offer much higher force and strains than the most commonly available magnetostrictive materials. Magnetic shape memory materials are not strictly speaking magnetostrictive. However, as they are magnetic field controlled they are to be considered as magnetostrictive actuators for the purposes of the present invention.

In this arrangement, the positioning of the upper load-cell is typically such that the static axial loading from the drill string can be measured. The position of the lower load-cell is typically such that dynamic loading passing from the oscillator through the vibration transmission unit to the drill-bit can be measured. The order of the components of the apparatus of this embodiment is particularly preferred to be from (i)-(viii) above from the top down.

In further embodiments of the invention, the rotary drilling module comprises:

(i) an upper load-cell for measuring static loading;
(ii) a vibration isolation unit;
(iii) an oscillator for applying axial oscillatory loading to the rotary drill-bit;
(iv) a lower load-cell for measuring dynamic axial loading;
(v) a drill-bit connector; and
(vi) a drill-bit, wherein the upper load-cell positioned above the vibration isolation unit and the lower load-cell is positioned between the oscillator and the drill-bit wherein the upper and lower load-cells are connected to a controller in order to provide down-hole closed loop real time control of the oscillator.

It is envisaged that this drilling module will be employed as a resonance enhanced drilling module in a drill-string. The drill-string configuration is not especially limited, and any configuration may be envisaged, including known configurations. The module may be turned on or off as and when resonance enhancement is required.

In this apparatus arrangement, the oscillator typically comprises an electrically driven mechanical actuator. The mechanical actuator is not especially limited, and preferably comprises a VR2510 actuator from Vibratechniques Ltd.

An electrically driven mechanical actuator can use the concept of two eccentric rotating masses to provide the needed axial vibrations. Such a vibrator module is composed of two eccentric counter-rotating masses as the source of high-frequency vibrations. The displacement provided by this arrangement can be substantial (approximately 2 mm). Suitable mechanical vibrators based on the principle of counter-rotating eccentric masses are available from Vibratechniques Ltd. One possible vibrator for certain embodiments of the present invention is the VR2510 model. This vibrator rotates the eccentric masses at 6000 rpm which corresponds to an equivalent vibration frequency of 100 Hz. The overall weight of the unit is 41 kg and the unit is capable of delivering forces up to 24.5 kN. The power consumption of the unit is 2.2 kW.

This drilling module arrangement differs from the first drilling module arrangement in that no vibration transmission unit is necessarily required to mechanically amplify the vibrations. This is because the mechanical actuator provides sufficient amplitude of vibration itself. Furthermore, as this technique relies on the effect of counter-rotating masses, the heavy back mass used in the magnetostrictive embodiment is not required.

In this arrangement, the positioning of the upper load-cell is typically such that the static axial loading from the drill string can be measured. The position of the lower load-cell is typically such that dynamic loading passing from the oscillator to the drill-bit can be monitored. The order of the components of the apparatus of this embodiment is particularly preferred to be from (i)-(vi) above from the top down.

The apparatus of all of the arrangements of the invention gives rise to a number of advantages in the drilling modules. These include: increased drilling speed; better borehole stability and quality; less stress on apparatus leading to longer lifetimes; and greater efficiency reducing energy costs.

The preferred applications for all embodiments of the drilling modules are in large scale drilling apparatus, control equipment and methods of drilling for the oil and gas industry. However, other drilling applications may also benefit, including: surface drilling equipment, control equipment and methods of drilling for road contractors; drilling equipment, control equipment and method of drilling for the mining industry; hand held drilling equipment for home use and the like; specialist drilling, e.g. dentist drills.

During resonance enhanced drilling module operation, the rotary drill-bit is rotated relative to the sample, and an axially oriented dynamic loading is applied to the drill-bit by the oscillator to generate a crack propagation zone to aid the rotary drill-bit in cutting though material.

The oscillator and/or dynamic exciter is controlled in accordance with preferred methods of the present invention. Thus, the invention further provides a method for resonance enhanced rotary drilling comprising an apparatus as defined above, the method comprising:

controlling frequency (f) of the oscillator in the resonance enhanced rotary drill whereby the frequency (f) is maintained in the range:

$$(D^2U_s/(8000\pi Am))^{1/2} \leq f \leq S_f(D^2U_s/(8000\pi Am))^{1/2}$$

where D is diameter of the rotary drill-bit, $U_s$ is compressive strength of material being drilled, A is amplitude of vibration, m is vibrating mass, and $S_f$ is a scaling factor greater than 1; and controlling dynamic force ($F_d$) of the oscillator in the resonance enhanced rotary drill whereby the dynamic force ($F_d$) is maintained in the range:

$$[(\pi/4)D^2_{eff}U_s] \leq F_d \leq S_{Fd}[(\pi/4)D^2_{eff}U_s]$$

where $D_{eff}$ is an effective diameter of the rotary drill-bit, $U_s$ is a compressive strength of material being drilled, and $S_{Fd}$ is a scaling factor greater than 1, wherein the frequency (f) and the dynamic force ($F_d$) of the oscillator are controlled by monitoring signals representing the compressive strength ($U_s$) of the material being drilled and adjusting the frequency (f) and the dynamic force ($F_d$) of the oscillator using a closed loop real-time feedback mechanism according to changes in the compressive strength ($U_s$) of the material being drilled.

The ranges for the frequency and dynamic force are based on the following analysis.

The compressive strength of the formation gives a lower bound on the necessary impact forces. The minimum required amplitude of the dynamic force has been calculated as:

$$F_d = \frac{\pi}{4} D^2_{eff} U_s.$$

$D_{eff}$ is an effective diameter of the rotary drill-bit which is the diameter D of the drill-bit scaled according to the fraction of the drill-bit which contacts the material being drilled. Thus, the effective diameter $D_{eff}$ may be defined as:

$$D_{eff} = \sqrt{S_{contact}}D,$$

where $S_{contact}$ is a scaling factor corresponding to the fraction of the drill-bit which contacts the material being drilled. For example, estimating that only 5% of the drill-bit surface is in contact with the material being drilled, an effective diameter $D_{eff}$ can be defined as:

$$D_{eff} = \sqrt{0.05}D.$$

The aforementioned calculations provide a lower bound for the dynamic force of the oscillator. Utilizing a dynamic force greater than this lower bound generates a crack propagation zone in front of the drill-bit during operation. However, if the dynamic force is too large then the crack propagation zone will extend far from the drill-bit compromising borehole stability and reducing borehole quality. In addition, if the dynamic force imparted on the rotary drill by the oscillator is too large then accelerated and catastrophic tool wear and/or failure may result. Accordingly, an upper bound to the dynamic force may be defined as:

$$S_{Fd}[(\pi/4)D^2_{eff}U_s]$$

where $S_{Fd}$ is a scaling factor greater than 1. In practice $S_{Fd}$ is selected according to the material being drilled so as to ensure that the crack propagation zone does not extend too far from the drill-bit compromising borehole stability and reducing borehole quality.

Furthermore, $S_{Fd}$ is selected according to the robustness of the components of the rotary drill to withstand the impact forces of the oscillator. For certain applications $S_{Fd}$ will be selected to be less than 5, preferably less than 2, more preferably less than 1.5, and most preferably less than 1.2.

Low values of $S_{Fd}$ (e.g. close to 1) will provide a very tight and controlled crack propagation zone and also increase lifetime of the drilling components at the expensive of rate of propagation. As such, low values for $S_{Fd}$ are desirable when a very stable, high quality borehole is required. On the other hand, if rate of propagation is the more important consideration then a higher value for $S_{Fd}$ may be selected.

During impacts of the oscillator of period $\tau$, the velocity of the drill-bit of mass m changes by an amount $\Delta v$, due to the contact force F=F(t):

$$m\Delta V = \int_0^{\tau} F(t)dt,$$

where the contact force F(t) is assumed to be harmonic. The amplitude of force F(t) is advantageously higher than the force $F_d$ needed to break the material being drilled. Hence a lower bound to the change of impulse may be found as follows:

$$m\Delta V = \int_0^{\tau} F_d \sin\left(\frac{\pi t}{\tau}\right)dt = \frac{1}{2}U_s 0.05D^2\tau.$$

Assuming that the drill-bit performs a harmonic motion between impacts, the maximum velocity of the drill-bit is $v_m = A\omega$, where A is the amplitude of the vibration, and $\omega = 2\pi f$ is its angular frequency. Assuming that the impact occurs when the drill-bit has maximum velocity $v_m$, and that the drill-bit stops during the impact, then $\Delta v = v_m = 2A\pi f$. Accordingly, the vibrating mass is expressed as $$m = \frac{0.05D^2 U_s \tau}{4\pi f A}.$$

This expression contains $\tau$, the period of the impact. The duration of the impact is determined by many factors, including the material properties of the formation and the tool, the frequency of impacts, and other parameters. For simplicity, $\tau$ is estimated to be 1% of the time period of the vibration, that is, $\tau = 0.01/f$. This leads to a lower estimation of the frequency that can provide enough impulse for the impacts:

$$f = \sqrt{\frac{D^2 U_s}{8000\pi A m}}.$$

The necessary minimum frequency is proportional to the inverse square root of the vibration amplitude and the mass of the bit.

The aforementioned calculations provide a lower bound for the frequency of the oscillator. As with the dynamic force parameter, utilizing a frequency greater than this lower bound generates a crack propagation zone in front of the drill-bit during operation. However, if the frequency is too large then the crack propagation zone will extend far from the drill-bit compromising borehole stability and reducing borehole quality. In addition, if the frequency is too large then accelerated and catastrophic tool wear and/or failure may result. Accordingly, an upper bound to the frequency may be defined as:

$$S_f(D^2 U_s/(8000\pi A m))^{1/2}$$

where $S_f$ is a scaling factor greater than 1. Similar considerations to those discussed above in relation to $S_{Fd}$ apply to the selection of $S_f$. Thus, for certain applications $S_f$ will be selected to be less than 5, preferably less than 2, more preferably less than 1.5, and most preferably less than 1.2.

In addition to the aforementioned considerations for operational frequency of the oscillator, it is advantageous that the frequency is maintained in a range which approaches, but does not exceed, peak resonance conditions for the material being drilled. That is, the frequency is advantageously high enough to be approaching peak resonance for the drill-bit in contact with the material being drilled while being low enough to ensure that the frequency does not exceed that of the peak resonance conditions which would lead to a dramatic drop off in amplitude. Accordingly, $S_f$ is advantageously selected whereby:

$$f_r/S_r \leq f \leq f_r$$

where $f_r$ is a frequency corresponding to peak resonance conditions for the material being drilled and $S_r$ is a scaling factor greater than 1.

Similar considerations to those discussed above in relation to $S_{Fd}$ and $S_f$ apply to the selection of $S_r$. For certain applications $S_r$ will be selected to be less than 2, preferably less than 1.5, more preferably less than 1.2. High values of $S_r$ allow lower frequencies to be utilized which can result in a smaller crack propagation zone and a lower rate of propagation. Lower values of $S_r$ (i.e. close to 1) will constrain the frequency to a range close to the peak resonance conditions which can result in a larger crack propagation zone and a higher rate of propagation. However, if the crack propagation zone becomes too large then this may compromise borehole stability and reduce borehole quality.

One problem with drilling through materials having varied resonance characteristics is that a change in the resonance characteristics could result in the operational frequency suddenly exceeding the peak resonance conditions which would lead to a dramatic drop off in amplitude. To solve this problem it may be appropriate to select $S_f$ whereby:

$$f \leq (f_r - X)$$

where X is a safety factor ensuring that the frequency (f) does not exceed that of peak resonance conditions at a transition between two different materials being drilled. In such an arrangement, the frequency may be controlled so as to be maintained within a range defined by:

$$f_r/S_r \leq f \leq (f_r - X)$$

where the safety factor X ensures that the frequency is far enough from peak resonance conditions to avoid the operational frequency suddenly exceeding that of the peak resonance conditions on a transition from one material type to another which would lead to a dramatic drop off in amplitude.

Similarly a safety factor may be introduced for the dynamic force. For example, if a large dynamic force is being applied for a material having a large compressive strength and then a transition occurs to a material having a much lower compressive strength, this may lead to the dynamic force suddenly being much too large resulting in the crack propagation zone extend far from the drill-bit compromising borehole stability and reducing borehole quality at material transitions. To solve this problem it may be appropriate to operate within the following dynamic force range:

$$F_d \leq S_{Fd}[(\pi/4)D^2_{eff}U_s - Y]$$

where Y is a safety factor ensuring that the dynamic force ($F_d$) does not exceed a limit causing catastrophic extension of cracks at a transition between two different materials being drilled. The safety factor Y ensures that the dynamic force is not too high that if a sudden transition occurs to a material which has a low compressive strength then this will not lead to catastrophic extension of the crack propagation zone compromising borehole stability.

The safety factors X and/or Y may be set according to predicted variations in material type and the speed with which the frequency and dynamic force can be changed when a change in material type is detected. That is, one or both of X and Y are preferably adjustable according to predicted variations in the compressive strength ($U_s$) of the material being drilled and speed with which the frequency (f) and dynamic force ($F_d$) can be changed when a change in the compressive strength ($U_s$) of the material being drilled is detected. Typical ranges for X include: $X>f_r/100$; $X>f_r/50$; or $X>f_r/10$. Typical ranges for Y include: $Y>S_{Fd}$ $[(\pi/4)D^2_{eff}U_s]/100$; $Y>S_{Fd}$ $[(\pi/4)D^2_{eff}U_s]/50$; or $Y>S_{Fd}$ $[(\pi/4)D^2_{eff}U_s]/10$.

Embodiments which utilize these safety factors may be seen as a compromise between working at optimal operational conditions for each material of a composite strata structure and providing a smooth transition at interfaces between each layer of material to maintain borehole stability at interfaces.

The previously described embodiments of the present invention are applicable to any size of drill or material to be drilled. Certain more specific embodiments are directed at drilling modules for drilling through rock formations, particularly those of variable composition, which may be encountered in deep-hole drilling applications in the oil, gas and mining industries. The question remains as to what numerical values are suitable for drilling through such rock formations.

The compressive strength of rock formations has a large variation, from around $U_s$=70 MPa for sandstone up to $U_s$=230 MPa for granite. In large scale drilling applications such as in the oil industry, drill-bit diameters range from 90 to 800 mm (3½ to 32"). If only approximately 5% of the drill-bit surface is in contact with the rock formation then the lowest value for required dynamic force is calculated to be approximately 20 kN (using a 90 mm drill-bit through sandstone). Similarly, the largest value for required dynamic force is calculated to be approximately 6000 kN (using an 800 mm drill-bit through granite). As such, for drilling through rock formations the dynamic force is preferably controlled to be maintained within the range 20 to 6000 kN depending on the diameter of the drill-bit. As a large amount of power will be consumed to drive an oscillator with a dynamic force of 6000 kN it may be advantageous to utilize the invention with a mid-to-small diameter drill-bit for many applications. For example, drill-bit diameters of 90 to 400 mm result in an operational range of 20 to 1500 kN. Further narrowing the drill-bit diameter range gives preferred ranges for the dynamic force of 20 to 1000 kN, more preferably 20 to 500 kN, more preferably still 20 to 300 kN.

A lower estimate for the necessary displacement amplitude of vibration is to have a markedly larger vibration than displacements from random small scale tip bounces due to inhomogeneities in the rock formation. As such the amplitude of vibration is advantageously at least 1 mm. Accordingly, the amplitude of vibration of the oscillator may be maintained within the range 1 to 10 mm, more preferably 1 to 5 mm.

For large scale drilling equipment the vibrating mass may be of the order of 10 to 1000 kg. The feasible frequency range for such large scale drilling equipment does not stretch higher than a few hundred Hertz. As such, by selecting suitable values for the drill-bit diameter, vibrating mass and amplitude of vibration within the previously described limits, the frequency (f) of the oscillator can be controlled to be maintained in the range 100 to 500 Hz while providing sufficient dynamic force to create a crack propagation zone for a range of different rock types and being sufficiently high frequency to achieve a resonance effect.

A controller may be configured to perform the previously described method and incorporated into a resonance enhanced rotary drilling module such as those described in the various embodiments of the invention above. The resonance enhanced rotary drilling module may be provided with sensors (the load cells) which monitor the compressive strength of the material being drilled, either directly or indirectly, and provide signals to the controller which are representative of the compressive strength of the material being drilled. The controller is configured to receive the signals from the sensors and adjust the frequency (f) and the dynamic force ($F_d$) of the oscillator using a closed loop real-time feedback mechanism according to changes in the compressive strength ($U_s$) of the material being drilled.

The inventors have determined that, the best arrangement for providing feedback control is to locate all the sensing, processing and control elements of the feedback mechanism within a down hole assembly. This arrangement is the most compact, provides faster feedback and a speedier response to changes in resonance conditions, and also allows drill heads to be manufactured with the necessary feedback control integrated therein such that the drill heads can be retro fitted to existing drill strings without requiring the whole of the drilling system to be replaced.

In addition to the resonance enhanced rotary drilling applications of the present invention, the spring system may advantageously be employed in other systems involving the requirement to damp and/or isolate vibration, and/or to enhance, promote, and/or transmit vibration. The spring systems used in the present invention are especially useful in high torsion environments, where traditional springs, such as coil springs, perform poorly. Coil springs, for example, may easily deform under torsional load, and lose the required spring characteristics.

Accordingly, the present invention further provides a vibration damping and/or isolation unit comprising a spring system comprising two or more frusto-conical springs arranged in series. The invention similarly provides a vibration enhancement and/or transmission unit comprising a spring system comprising two or more frusto-conical springs arranged in series.

In such units, it is typical that the spring system is one such that the force, P, applied to the spring system can be determined according to the following equation:

$$P = \frac{1.1E\delta C}{R^2}\left[(h-\delta)\left(h-\frac{\delta}{2}\right)t + t^2\right]$$

wherein t is the thickness of the frusto-conical springs, h is the height of the spring system, R is the radius of the spring system, δ is the displacement on the spring system caused by the force P, E is the Young modulus of the spring system, and C is the constant of the spring system.

In some embodiments in the units described above, the spring system comprises one or more Belleville springs. Typically, when the spring system is for damping and/or isolating vibration, it satisfies the following equation:

$$\omega/\omega_n \geq 2.3$$

wherein $\omega$ represents an operational frequency of axial vibration, and $\omega_n$ represents the natural frequency of the spring system of the unit. Alternatively, when the spring system is for enhancing and/or transmitting vibration, it typically satisfies the following equation:

$$0.6 \leq \omega/\omega_n \leq 1.2$$

wherein $\omega$ represents an operational frequency of axial vibration, and $\omega_n$ represents the natural frequency of the spring system of the unit.

the invention also provides use of a spring system comprising two or more frusto-conical springs arranged in series in a high-torsion environment. The use may involve damping and/or isolating vibration, or may be for enhancing and/or transmitting vibration.

The spring characteristics, and other preferred embodiments for the uses are as already outlined above.

The invention will now be described further, by way of example only, with reference to the following specific embodiments, models and experiments.

EXAMPLES

In accordance with the present invention, a vibration isolation unit (a vibro-isolator) and a vibration transmission unit (a spring) were made from the BS970-080M50 medium carbon steel (also referred to as AISI-1050). The mechanical properties of the steel are given in Table 1.

TABLE 1

Mechanical properties of AISI-1050 Steel.

| Property | Value |
|---|---|
| Density | 7900 kg/m$^3$ |
| Young's Modulus | 216 GPa |
| Shear Modulus | 80 GPa |
| Poisson's ratio | 0.285 |
| Yield Strength | 455 MPa |
| Tensile Strength | 790 MPa |
| Fatigue Strength @10$^7$ (Stress ratio = 0) | 199 MPa |

It is worth noting that this material differs from those typically used in the manufacture of Belleville springs. However, because the loads applied in the experimental rig are relatively low as a result of the small size of the drill-bit, it was considered that this material was strong enough to withstand the applied loads from the experimental rig.

Figure 5:
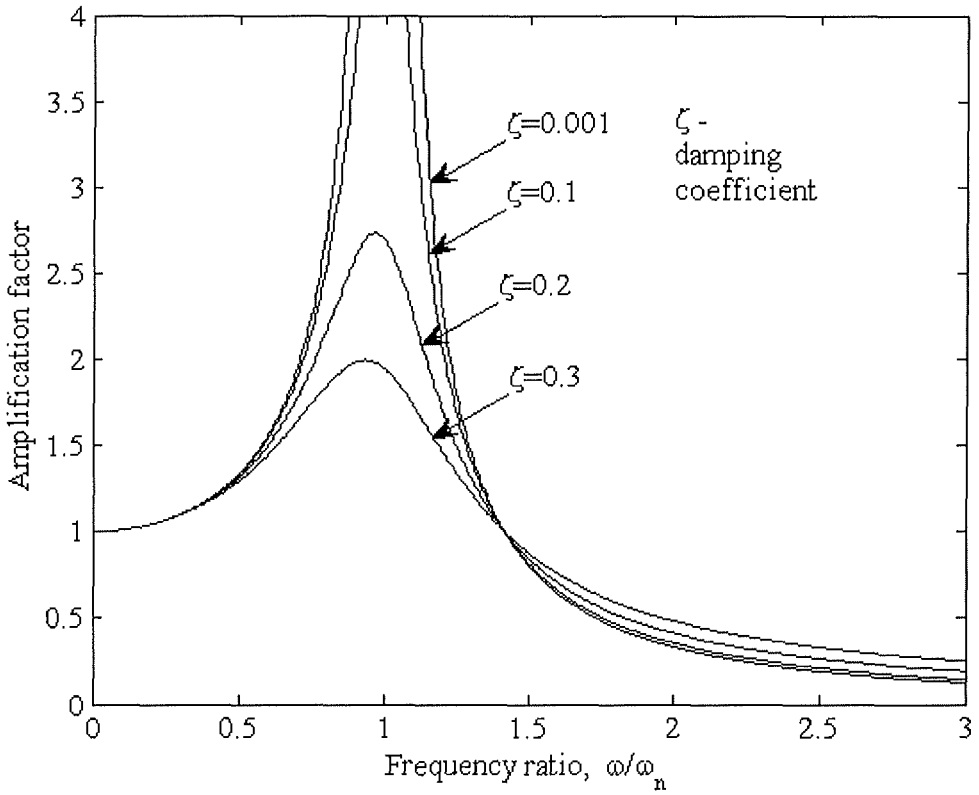
FIG. 5 shows an amplification factor diagram for different damping coefficients for vibration transmission units of the invention.

The vibro-isolator can be modelled as a typical vibration isolation problem. On the other hand, the spring may be represented by a base excitation dynamical problem. If it is assumed that the springs have a linear response, then it has been established that the relationship between the amplification factor, i.e. the ratio of the dynamic to static response, and the ratio of the frequency of oscillation to the natural frequency of the system is the same for both problems. A typical amplification diagram is shown in FIG. 5 for different damping coefficients.

It can be appreciated from FIG. 5 that for the structural spring, assuming linear response of the spring, the motion of the resonator is amplified when the value of the natural frequency of the system consisting of the masses below it and spring itself is close to that of the forcing frequency of the resonator. By taking into consideration the nonlinear effects, damping and other factors, it is possible to predict from the amplification diagram that the acceptable frequency ratio range for the spring can expressed as $$0.6 \leq \omega/\omega_n \leq 1.2$$

In the case of the vibro-isolator, the dynamic system is represented by the spring and all the masses below it, i.e. the PEX, back-mass, torque frame, structural spring, load cell housing, bit adaptor and the drill-bit. If similar suppositions are made for the vibro-isolator spring, it is possible to adopt the condition for the stiffness design as $$\omega/\omega_n \geq 2.3$$

This criterion ensures that less than 25% of the amplitude of the forcing is transmitted to the frame since steels usually exhibit a very low mechanical loss factor (a function of damping or hysteresis). Hence the stiffness of the vibro-isolator is typically less than that of the structural spring. These assumptions may be adopted in the calculation of the spring stiffness and the conditions in the equations above may typically form part of basis for the selection of the best thickness for the springs.

In order to numerically model the actions of the springs accurately, it is important to consider the type of loading and restraint involved and their respective position on the spring.

Figure 6:
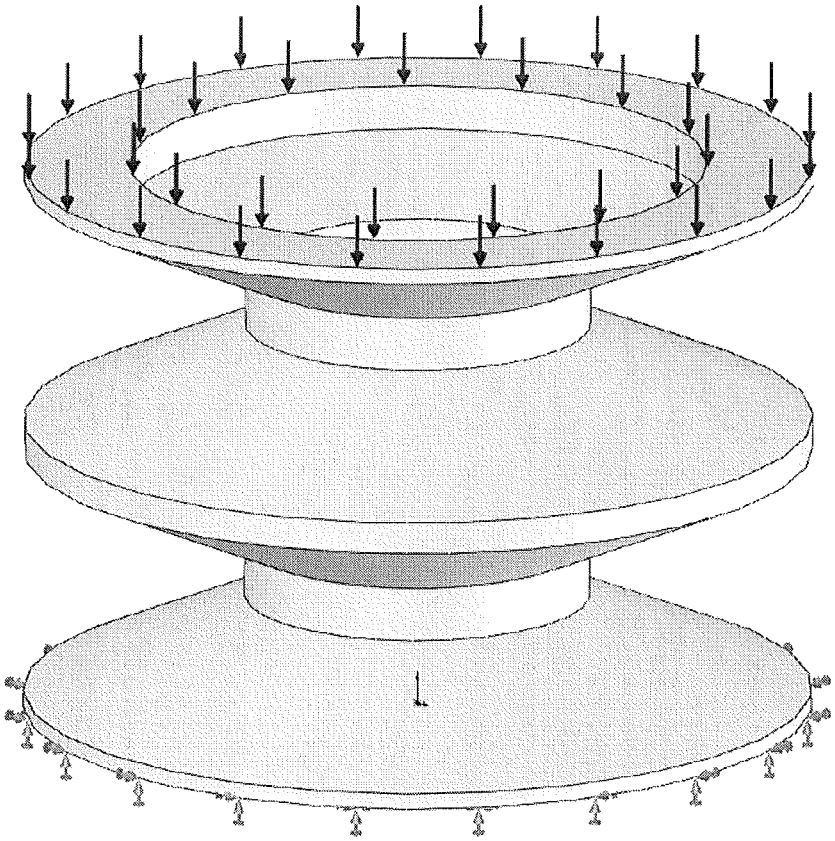
FIGS. 6 and 7 shows how the vibrational isolation unit and the vibrational transmission unit can be modelled—both springs can be considered as fixed at one end and free at the other as shown in the Figures—arrows represent the force on the top face, which is free to move, and the restraints on the bottom face, which is fixed.
Figure 7:
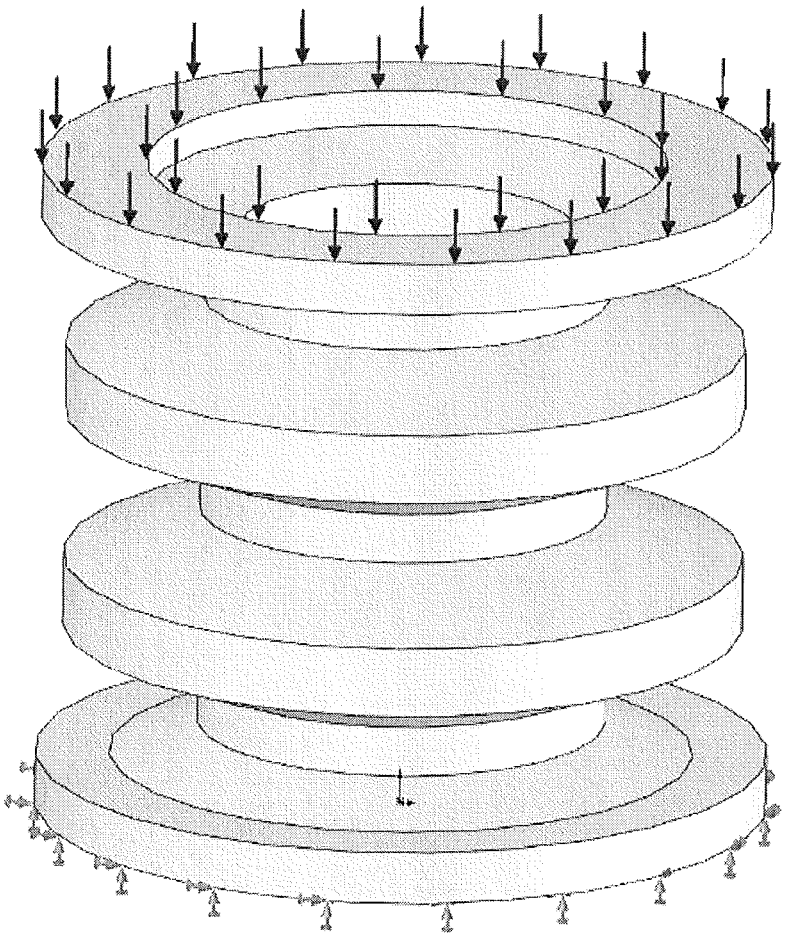

It has been mentioned earlier that the system comprising the structural spring and the masses below could be modelled as a base excitation problem, while the system comprising of the vibro-isolator and masses below it represent a vibration isolation problem. This suggests both springs could be considered as fixed at one end and free at the other as shown in FIGS. 6 and 7. Here, the arrows represent the force on the top face which is free to move and on the bottom face represent the restraints and suggest the face is fixed.

To facilitate the calculation of stresses on the spring, it is important that all the forces acting on the spring be identified. First, it should be considered that when the drill-bit is not in contact with rock, the springs are under the influence of the weight of the masses below it. Second, when the drilling takes place without the resonator action, the spring now has an additional load applied to it from the reaction of the rock. When the resonator starts to operate, there is an extra loading due to oscillations. The net load on the spring is sum of the three loads identified.

It was observed from earlier experiments that the average weight on bit that produced best performance when using the RED module was about 1500 N and the approximate amplitude of the varying load during the operation of the resonator was 1000 N. It is then possible to estimate the maximum load on the spring during the RED drilling experiments. It is worth noting that while load applied by the masses below the spring is tensile, the weight on bit is compressive and the load supplied by the resonator is alternating about a zero mean. The maximum load on each spring can then be estimated as shown in Table 2.

TABLE 2

Estimations of loads

| Vibro-isolator Spring | Structural Spring |
|---|---|
| Weight on bit = 1500N<br>Amplitude of alternating load = 1000N | Weight on bit = 1500N<br>Amplitude of alternating load = 1000N |

TABLE 2-continued

| Estimations of loads | |
|---|---|
| Vibro-isolator Spring | Structural Spring |
| Weight of masses below = 114 kg × 10 m/s$^2$ = 1140N<br>Net load = 1500 + 1000 − 1140 = 1360N | Weight of masses below = 18 kg × 10 m/s$^2$ = 180N<br>Net load = +1000 − 180 = 2320N |

FIGS. 8*a* and 8*b* present a graphical approximation of the loading condition during the RED drilling process for both springs at a frequency of 250 Hz. Since the stress is proportional to the forces, the stress ratio R defined as the ratio of the minimum stress to the maximum stress is then proportional to the ratio of the minimum force to maximum force. Therefore for the vibro-isolator this given as $$R = \frac{F_{min}}{F_{max}} = \frac{-640}{1360} = -0.47.$$

In the case of the transmission unit (structural spring) we have $$R = \frac{F_{min}}{F_{max}} = \frac{320}{2320} = 0.14.$$

Natural frequencies of both parts were predicted using the stiffness estimated from the maximum applied load and the maximum displacement in the axial direction. The frequency ratio is then found by dividing the forcing frequency, taken for the purpose of the design optimisation as 250 Hz from observed experimental results, by the natural frequency for the spring. The minimum factors of safety and cumulative damage were also predicted for the analysis. Tables 3 and 4 give the summary of the results obtained for the vibro-isolator and the structural spring respectively.

The invention claimed is:

1. An apparatus for testing or use in resonance enhanced rotary drilling, which apparatus comprises:

(a) a vibration damping and/or isolation unit; and (b) a vibration enhancement and/or transmission unit, wherein the vibration damping and/or isolation unit and the vibration enhancement and/or transmission unit comprise a spring system comprising two or more frusto-conical springs arranged in series, wherein a frustoconical spring of the vibration damping and/or isolation unit satisfies the following equation:

$$\omega/\omega_{n1} \geq 2.3$$

wherein ω represents an operational frequency of axial vibration of the resonance enhanced rotary drilling apparatus, and $\omega_{n1}$ represents the natural frequency of the frustoconical spring of the vibration damping and/or isolation unit; and wherein the frustoconical spring of the vibration enhancement and/or transmission unit satisfies the following equation:

$$0.6 \leq \omega/\omega_{n2} \leq 1.2$$

wherein $\omega_{n2}$ represents the natural frequency of the frustoconical spring of the vibration enhancement and/or transmission unit, wherein the vibration damping and/or isolation unit, as situated above an oscillator in the resonance enhanced rotary drilling apparatus, dampens and/or isolates vibration from the oscillator, and wherein the vibration enhancement and/or transmission unit, as situated below an oscillator in the resonance enhanced rotary drilling apparatus, enhances and/or transmits vibration from the oscillator.

2. An apparatus according to claim 1, wherein the frustoconical spring is one such that the force, P, applied to the frustoconical spring can be determined according to the following equation:

TABLE 3

Summary of results for the vibro-isolator

| Size [mm] | Max Displ. [mm] | Average Stiffness [N/m] | Freq. [Hz] | Max. Von-Mises Stress [MPa] | Estimated Damage@ $10^6$ Cycles | Fatigue Life [Cycles] | Minimum Factor of Safety |
|---|---|---|---|---|---|---|---|
| 2.5 | 3.30E−05 | 4.13E+07 | 95.75 | 15.95 | 1% | 1.00E+08 | 17.68 |
| 3 | 2.84E−05 | 4.79E+07 | 103.15 | 13.89 | 1% | 1.00E+08 | 20.66 |
| 3.5 | 2.50E−05 | 5.44E+07 | 109.94 | 13.28 | 1% | 1.00E+08 | 21.61 |
| 4 | 2.24E−05 | 6.07E+07 | 116.15 | 13.35 | 1% | 1.00E+08 | 19.95 |

TABLE 4

Summary of results for the spring

| Size [mm] | Max Displ. [mm] | Average Stiffness [N/m] | Freq. [Hz] | Max. Von-Mises Stress [MPa] | Estimated Damage@ $10^6$ Cycles | Fatigue Life [Cycles] | Minimum Factor of Safety |
|---|---|---|---|---|---|---|---|
| 4.5 | 2.22E−05 | 1.05E+08 | 383.49 | 12.02 | 1% | 1.00E+08 | 41.10 |
| 5 | 2.00E−05 | 1.16E+08 | 404.43 | 11.75 | 1% | 1.00E+08 | 42.03 |
| 5.5 | 1.81E−05 | 1.28E+08 | 424.59 | 10.70 | 1% | 1.00E+08 | 44.87 |
| 6 | 1.66E−05 | 1.40E+08 | 443.35 | 10.84 | 1% | 1.00E+08 | 44.30 |

$$P = \frac{1.1E\delta C}{R^2}\left[(h-\delta)\left(h-\frac{\delta}{2}\right)t + t^2\right]$$

wherein t is the thickness of the frusto-conical spring, h is the height of the frustoconical spring, R is the radius of the frustoconical spring, δ is the displacement on the frustoconical spring caused by the force P, E is the Young modulus of the frustoconical spring, and C is the constant of the frustoconical spring.

3. An apparatus according to claim 2, wherein the frustoconical spring comprises one or more Belleville springs.

4. An apparatus according to claim 1, wherein the frustoconical spring is formed from a metal.

5. An apparatus according to claim 1, which apparatus comprises:

(i) an upper load-cell for measuring static and dynamic axial loading;

(ii) an oscillator for applying axial oscillatory loading to the rotary drill bit;

(iii) a lower load-cell for measuring static and dynamic axial loading;

(iv) a drill-bit connector; and (v) a drill-bit, wherein the upper load-cell is positioned above the vibration damping and/or isolation unit and the lower load-cell is positioned between the vibration enhancement and/or transmission unit and the drill-bit, and wherein the upper and lower load-cells are connected to a controller in order to provide down-hole closed loop real time control of the oscillator.

6. An apparatus according to claim 5, wherein the oscillator comprises a magneto-strictive oscillator.

7. An apparatus according to claim 5, wherein the controller is configured to control the frequency (f) and the dynamic force ($F_d$) of the oscillator.

8. An apparatus according to claim 7, wherein the frequency (f) and the dynamic force ($F_d$) of the oscillator provides according to load cell measurements representing changes in the compressive strength ($U_s$) of material being drilled.

9. An apparatus according to claim 5, which apparatus further comprises an oscillator back mass.

10. An apparatus according to claim 1, which apparatus comprises:

(i) an upper load-cell for measuring static loading;

(ii) an oscillator for applying axial oscillatory loading to the rotary drill bit;

(iii) a lower load-cell for measuring dynamic axial loading;

(iv) a drill-bit connector; and (v) a drill-bit, wherein the upper load-cell positioned above the vibration damping and/or isolation unit and the lower load-cell is positioned between the oscillator and the drill-bit wherein the upper and lower load-cells are connected to a controller in order to provide down-hole closed loop real time control of the oscillator.

11. An apparatus according to claim 10, wherein the oscillator comprises an electrically driven mechanical actuator.

12. An apparatus according to claim 1, which apparatus further comprises:

(i) a resonance enhanced rotary drilling module comprising an oscillator;

(ii) a fixed frame for fixing the apparatus to a base surface;

(iii) a movable frame for moving the rotary drilling module in an axial direction relative to a sample;

(iv) a means for generating relative rotary motion between the drilling module and a sample; and (v) a torsion restraint unit for reducing the torsional loading on the oscillator.

13. An apparatus according to claim 12, wherein an upper load-cell is positioned above the vibration damping and/or isolation unit and a lower load-cell is positioned between the vibration enhancement and/or transmission unit and a drill-bit, and wherein the upper and lower load-cells are connected to a controller in order to provide down-hole closed loop real time control of the oscillator.

14. A method of drilling comprising operating an apparatus as defined in claim 1.

15. A method of drilling according to claim 14, the method comprising controlling an operational frequency of axial vibration of the resonance enhanced rotary drilling apparatus such that the frustoconical spring system of the vibration damping and/or isolation unit satisfies the following equation:

$$\omega/\omega_n \geq 2.3$$

wherein ω represents an operational frequency of axial vibration of the resonance enhanced rotary drilling apparatus, and $\omega_n$ represents the natural frequency of the frustoconical spring of the vibration isolation unit.

16. A method of drilling according to claim 14, the method comprising controlling an operational frequency of axial vibration of the resonance enhanced rotary drilling apparatus such that the frustoconical spring of the vibration enhancement and/or transmission unit satisfies the following equation:

$$0.6 \leq \omega/\omega_n \leq 1.2$$

wherein ω represents an operational frequency of axial vibration of the resonance enhanced rotary drilling apparatus, and $\omega_n$ represents the natural frequency of the frustoconical spring of the vibration transmission unit.

17. A method according to claim 14, wherein the method further comprises controlling the amplitude of vibration of the oscillator to be maintained within the range 0.5 to 10 mm.

18. A method according to claim 14, wherein the frequency (f) of the oscillator is controlled to be maintained in the range 100 Hz and above.

19. A method according to claim 14, wherein the dynamic force ($F_d$) is controlled to be maintained within the range up to 1000 kN.

20. A vibration damping and/or isolation unit comprising a spring system comprising a frusto-conical springs, wherein the frustoconical spring satisfies the following equation:

$$\omega/\omega_n \geq 2.3$$

wherein ω represents an operational frequency of axial vibration, and $\omega_n$ represents the natural frequency of the frustoconical spring of the unit and wherein the vibration dampening and/or isolation unit is situated above an oscillator and dampens and/or isolates vibration from the oscillator.

21. A vibration enhancement and/or transmission unit comprising a spring system comprising a frusto-conical springs, wherein the spring system satisfies the following equation:

$$0.6 \leq \omega/\omega_n \leq 1.2$$

wherein ω represents an operational frequency of axial vibration, and $\omega_n$ represents the natural frequency of the frustoconical spring of the unit and wherein the vibration enhancement and/or transmission unit is situated below an oscillator and enhances and/or transmits vibration from the oscillator.

22. A method of using a spring system comprising a frusto-conical spring in a high-torsion environment, wherein the frustoconical spring is for vibration damping and/or isolation and satisfies the following equation:

$$\omega/\omega_n \geq 2.3$$

wherein ω represents an operational frequency of axial vibration, and $\omega_n$ represents the natural frequency of the frustoconical spring of the unit and wherein the spring system is situated above an oscillator and dampens and/or isolates vibration from the oscillator, or wherein the frustoconical spring is for vibration enhancement and/or transmission and satisfies the following equation:

$$0.6 \leq \omega/\omega_\eta \leq 1.2$$

wherein $\omega_\eta$ represents the natural frequency of the frustoconical spring and wherein the spring system is situated below an oscillator and enhances and/or transmits vibration from the oscillator.

23. A method according to claim 22, wherein the frustoconical spring is one such that the force, P, applied to the frustoconical spring can be determined according to the following equation:

$$P = \frac{1.1E\delta C}{R^2}\left[(h-\delta)\left(h-\frac{\delta}{2}\right)t + t^2\right]$$

wherein t is the thickness of the frusto-conical springs, h is the height of the frustoconical spring, R is the radius of the frustoconical spring, δ is the displacement on the frustoconical spring caused by the force P, E is the Young modulus of the frustoconical spring, and C is the constant of the frustoconical spring.

24. The method according to claim 22, wherein the frustoconical spring comprises one or more Belleville springs.

25. The method according to claim 22, wherein the frustoconical spring is formed from a metal.

26. A unit according to claim 20 or claim 21, wherein the frustoconical spring is one such that the force, P, applied to the frustoconical spring can be determined according to the following equation:

$$P = \frac{1.1E\delta C}{R^2}\left[(h-\delta)\left(h-\frac{\delta}{2}\right)t + t^2\right]$$

wherein t is the thickness of the frusto-conical spring, h is the height of the frustoconical spring, R is the radius of the spring system, δ is the displacement on the frustoconical spring caused by the force P, E is the Young modulus of the frustoconical spring, and C is the constant of the frustoconical spring.

27. A unit according to claim 20 or 21, wherein the frustoconical spring comprises one or more Belleville springs.

28. A unit according to any of claim 20 or 21, wherein the frustoconical spring is formed from a metal.

* * * * *